US006142323A

United States Patent [19]

Veil, Sr. et al.

[11] Patent Number: 6,142,323

[45] Date of Patent: Nov. 7, 2000

[54] ADJUSTABLE SHELF DIVIDER

[76] Inventors: Lesley E. Veil, Sr.; Bobbie Veil, both of 71 Faringdon Dr., Crystal Lake, Ill. 60014

[21] Appl. No.: 09/224,314

[22] Filed: Dec. 31, 1998

[51] Int. Cl.[7] ..... A47F 5/00

[52] U.S. Cl. ..... 211/184; 211/184; 211/40; 211/43

[58] Field of Search ..... 211/184, 43, 175; 108/60, 61; 248/298.1; 24/557, 255 R, 257, 563, 30.5 P, 30.5 S

[56] References Cited

U.S. PATENT DOCUMENTS

| | | | |
|---|---|---|---|
| 910,616 | 1/1909 | Waters | 211/189 X |
| 1,733,487 | 10/1929 | Hackley | 211/43 X |
| 1,901,365 | 3/1933 | Field | 211/43 |
| 2,379,126 | 6/1945 | Welden | 211/43 X |
| 2,620,929 | 12/1952 | Sportsman | 211/42 |
| 3,170,213 | 2/1965 | Thomas, Jr. | 24/255 |
| 3,171,542 | 3/1965 | Jecobs et al. | 211/43 |
| 4,196,812 | 4/1980 | McInnis | 211/40 |
| 4,243,254 | 1/1981 | Hill et al. | 285/242 |
| 4,266,814 | 5/1981 | Gallagher | 285/319 |
| 4,470,180 | 9/1984 | Blomgren | 24/563 |
| 5,117,984 | 6/1992 | Kennedy | 211/43 X |
| 5,197,609 | 3/1993 | Siegel | 211/175 X |
| 5,386,350 | 1/1995 | Gross | 248/298.1 X |
| 5,513,048 | 4/1996 | Chen | 248/298.1 X |
| 5,584,512 | 12/1996 | Carstensen | 285/55 |

*Primary Examiner*—Blair M. Johnson
*Assistant Examiner*—Khoa Tran

[57] ABSTRACT

A adjustable shelf divider for dividing a shelf into a plurality of stalls for organizing items on the shelf. The adjustable shelf divider includes a plurality of spaced apart panels each having first and second faces, a plurality of sides and a plurality of corners. Each of the panels has a plurality of holes therethrough extending between the faces of the respective panel. The panels are arranged in a row with the first faces of the panels generally facing in a first common direction and the second faces of the panels generally facing in a second common direction opposite the first common direction. Each of the holes of each panel is generally coaxially aligned with a corresponding associated hole of each of the other panels. A plurality of elongate rods are provided with each group of corresponding associated holes of the panel having one of the rods extending therethrough.

1 Claim, 3 Drawing Sheets

ADJUSTABLE SHELF DIVIDER

BACKGROUND OF THE INVENTION

1. Field of the Invention

The present invention relates to shelf dividers and organizers and more particularly pertains to a new adjustable shelf divider for dividing a shelf into a plurality of stalls for organizing items on the shelf.

2. Description of the Prior Art

The use of shelf dividers and organizers is known in the prior art. More specifically, shelf dividers and organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,669,278 by Heroy; U.S. Pat. No. 5,209,360 by Valiulis; U.S. Pat. No. 4,190,167 by Wells et al.; U.S. Pat. No. 4,942,968 by Fast; U.S. Pat. No. 2,108,950 by Stober; and U.S. Pat. No. Des. 249,001 by Offredi.

While these devices fulfill their respective, particular objectives and requirements, the aforementioned patents do not disclose a new adjustable shelf divider. The inventive device includes a plurality of spaced apart panels each having first and second faces, a plurality of sides and a plurality of corners. Each of the panels has a plurality of holes therethrough extending between the faces of the respective panel. The panels are arranged in a row with the first faces of the panels generally facing in a first common direction and the second faces of the panels generally facing in a second common direction opposite the first common direction. Each of the holes of each panel is generally coaxially aligned with a corresponding associated hole of each of the other panels. A plurality of elongate rods are provided with each group of corresponding associated holes of the panel having one of the rods extending therethrough.

In these respects, the adjustable shelf divider according to the present invention substantially departs from the conventional concepts and designs of the prior art, and in so doing provides an apparatus primarily developed for the purpose of dividing a shelf into a plurality of stalls for organizing items on the shelf.

SUMMARY OF THE INVENTION

In view of the foregoing disadvantages inherent in the known types of shelf dividers and organizers now present in the prior art, the present invention provides a new adjustable shelf divider construction wherein the same can be utilized for dividing a shelf into a plurality of stalls for organizing items on the shelf.

The general purpose of the present invention, which will be described subsequently in greater detail, is to provide a new adjustable shelf divider apparatus and method which has many of the advantages of the shelf dividers and organizers mentioned heretofore and many novel features that result in a new adjustable shelf divider which is not anticipated, rendered obvious, suggested, or even implied by any of the prior art shelf dividers and organizers, either alone or in any combination thereof.

To attain this, the present invention generally comprises a plurality of spaced apart panels each having first and second faces, a plurality of sides and a plurality of corners. Each of the panels has a plurality of holes therethrough extending between the faces of the respective panel. The panels are arranged in a row with the first faces of the panels generally facing in a first common direction and the second faces of the panels generally facing in a second common direction opposite the first common direction. Each of the holes of each panel is generally coaxially aligned with a corresponding associated hole of each of the other panels. A plurality of elongate rods are provided with each group of corresponding associated holes of the panel having one of the rods extending therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new adjustable shelf divider apparatus and method which has many of the advantages of the shelf dividers and organizers mentioned heretofore and many novel features that result in a new adjustable shelf divider which is not anticipated, rendered obvious, suggested, or even implied by any of the prior art shelf dividers and organizers, either alone or in any combination thereof.

It is another object of the present invention to provide a new adjustable shelf divider which may be easily and efficiently manufactured and marketed.

It is a further object of the present invention to provide a new adjustable shelf divider which is of a durable and reliable construction.

An even further object of the present invention is to provide a new adjustable shelf divider which is susceptible of a low cost of manufacture with regard to both materials and labor, and which accordingly is then susceptible of low prices of sale to the consuming public, thereby making such adjustable shelf divider economically available to the buying public.

Still yet another object of the present invention is to provide a new adjustable shelf divider which provides in the apparatuses and methods of the prior art some of the advantages thereof, while simultaneously overcoming some of the disadvantages normally associated therewith.

Still another object of the present invention is to provide a new adjustable shelf divider for dividing a shelf into a plurality of stalls for organizing items on the shelf.

Yet another object of the present invention is to provide a new adjustable shelf divider which includes a plurality of spaced apart panels each having first and second faces, a plurality of sides and a plurality of corners. Each of the panels has a plurality of holes therethrough extending between the faces of the respective panel. The panels are arranged in a row with the first faces of the panels generally facing in a first common direction and the second faces of the panels generally facing in a second common direction opposite the first common direction. Each of the holes of each panel is generally coaxially aligned with a corresponding associated hole of each of the other panels. A plurality of elongate rods are provided with each group of corresponding associated holes of the panel having one of the rods extending therethrough.

Still yet another object of the present invention is to provide a new adjustable shelf divider that is adjustable to permit adjustment of the width of the stalls and may also be extendable to permit extending of the divider along longer shelves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
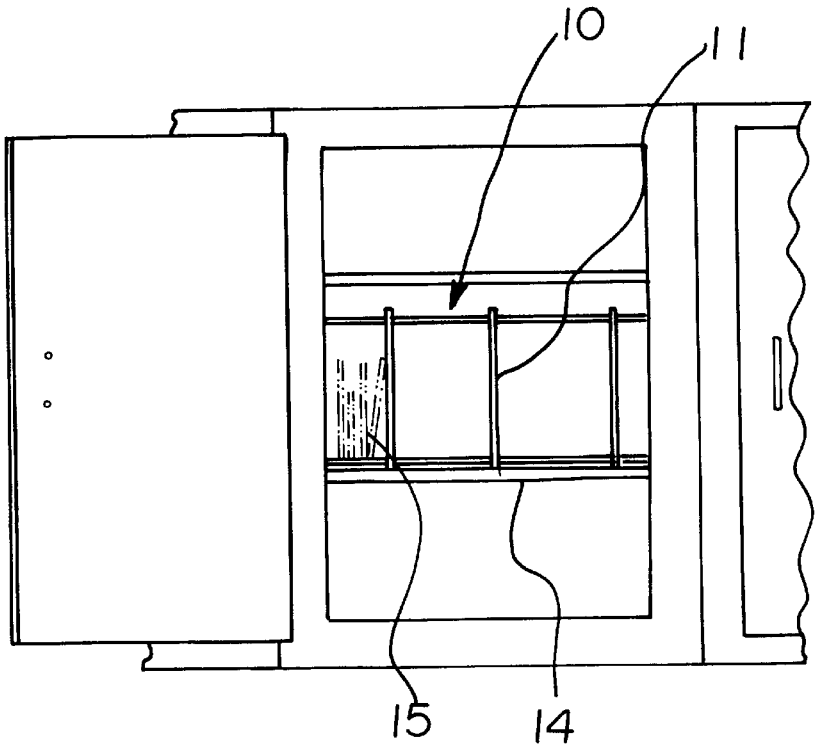
FIG. 1 is a schematic front view of a new adjustable shelf divider in use on a shelf of a cabinet according to the present invention.

With reference now to the drawings, and in particular to FIGS. 1 through 6 thereof, a new adjustable shelf divider embodying the principles and concepts of the present invention and generally designated by the reference numeral 10 will be described.

As best illustrated in FIGS. 1 through 6, the adjustable shelf divider 10 generally comprises a plurality of spaced apart panels each having first and second faces, a plurality of sides and a plurality of corners. Each of the panels has a plurality of holes therethrough extending between the faces of the respective panel. The panels are arranged in a row with the first faces of the panels generally facing in a first common direction and the second faces of the panels generally facing in a second common direction opposite the first common direction. Each of the holes of each panel is generally coaxially aligned with a corresponding associated hole of each of the other panels. A plurality of elongate rods are provided with each group of corresponding associated holes of the panel having one of the rods extending therethrough.

In closer detail, the shelf divider 10 comprises a plurality of spaced apart panels 11*a*,11*b*,11*c*,11*d*, each having substantially planar first and second faces, a plurality of substantially straight sides and a plurality of corners. Preferably, the panels each are generally rectangular such that the faces of each panel are generally rectangular, the plurality of sides of each panel comprises four sides, and the plurality of corners of each panel comprises four corners. Ideally, each of the panels is generally square and has sides each has a length of about 8 inches.

The panels each preferably comprises peg board and each have a plurality of spaced apart generally circular apertures 12 therethrough extending between the faces of the respective panel. The apertures are preferably arranged on the respective panel in a generally rectangular grid having a plurality of substantially parallel rows of apertures and a plurality of substantially parallel columns of apertures extending substantially perpendicular to the rows of apertures. In an ideal illustrative embodiment, each of the apertures has a diameter of about ⅛ inch.

Each of the panels also has a plurality of generally circular holes therethrough extending between the faces of the respective panel with a hole positioned adjacent each of the corners of the respective panel. Thus in the preferred embodiment, the plurality of holes of each panel comprises four holes.

Figure 2:
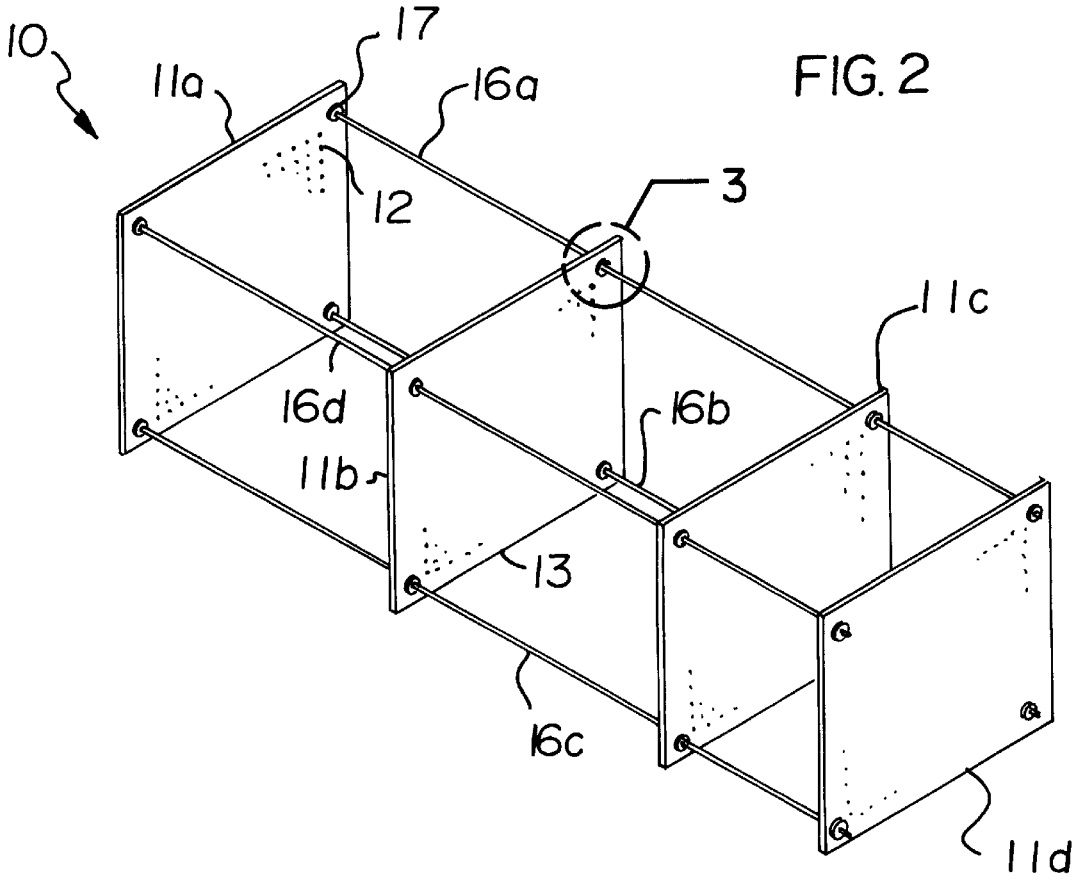
FIG. 2 is a schematic perspective view of the present invention.
Figure 3:
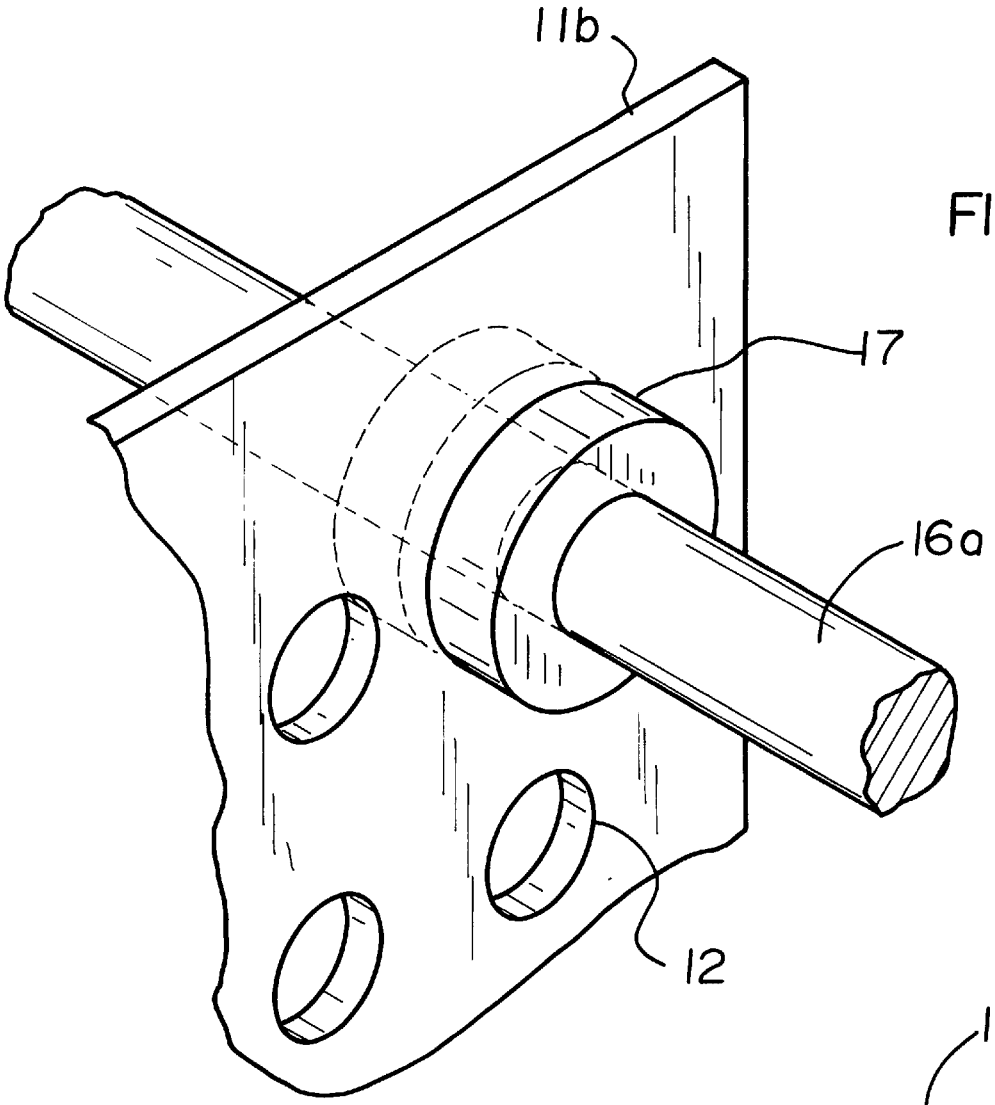
FIG. 3 is a schematic enlarged perspective view of a corner of a panel of the present invention taken from circle 3 on FIG. 2.

In use, a bottom side 13 of the plurality of sides of each panel is designed for resting on a resting surface such as a shelf 14, for example, in a cabinet. As best illustrated in FIG. 2, the panels are arranged in a row with the first faces of the panels generally facing in a first common direction and the second faces of the panels generally facing in a second common direction opposite the first common direction. Each adjacent pair of panels defining a stall therebetween. As illustrated in FIG. 1, the stalls are designed for organizing items 15 on a shelf that the panels are resting on. In the ideal illustrative embodiment illustrated in the Figures, the plurality of panels comprises four panels such that three stalls are formed.

The panels lie in generally parallel planes to one another. Preferably, the panels lie in generally vertical planes when resting on a horizontal resting surface. The holes of the corners of each panel are each generally coaxially aligned with a corresponding associated hole of each of the other panels.

A plurality of elongate rods 16*a*,16*b*,16*c*,16*d* are provided with each group of corresponding associated holes of the panel having one of the rods extending therethrough. In the preferred embodiment, the plurality of rods comprises four rods. Each of the rods has a pair of opposite ends and a longitudinal axis extending between the ends of the respective rod. Preferably, each of the rods has a generally circular transverse cross section taken substantially perpendicular to the longitudinal axis of the respective rod. The longitudinal axes of the rods are extended generally parallel to one another so that the longitudinal axes of the rods are extended generally horizontally when the bottom sides of the panels are rested on a horizontal resting surface.

Optionally, the rods may be each tubular. Also optionally, each of the rods may be telescopically extendable along the longitudinal axis of the respective rod. Each rod has a length defined between the ends of the respective rod. In the ideal illustrative embodiment, the length of each rod is between about 20 inches and about 30 inches. In this ideal illustrative embodiment, the circular transverse cross section of each rod has a diameter of preferably about ¼ inch.

Figure 4:
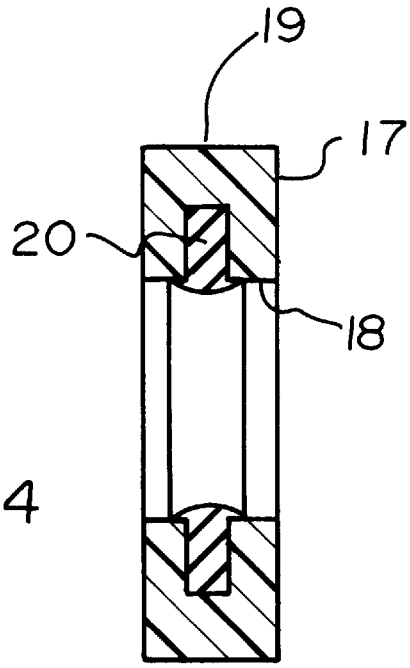
FIG. 4 is a schematic cross sectional view of a stop of the present invention.

Each of the rods has a plurality of annular stops 17 disposed therearound with each of the panels positioned between an associated pair of stops on each of the rods. With particular reference to FIG. 4, each of the stops has generally circular annular inner and outer surfaces 18,19 with the inner surface of each stop defining a generally circular bore through the respective stop, the rods is extended through the bores of the associated stops of the respective rod. Each of the stops has a resiliently compressible annular insert 20 made from a material such as resiliently compressible rubber extending radially inwards from the inner surface of the respective stop and extending around the associated rod extending through the bore of the associated stop. The inserts each have an inner diameter less than the diameter of the bore of the associated stop. The inner diameter of each insert is also less than the diameter of the associated rod such that the rod compress each insert to frictionally hold each stop in position on the associated rod.

Figure 5:
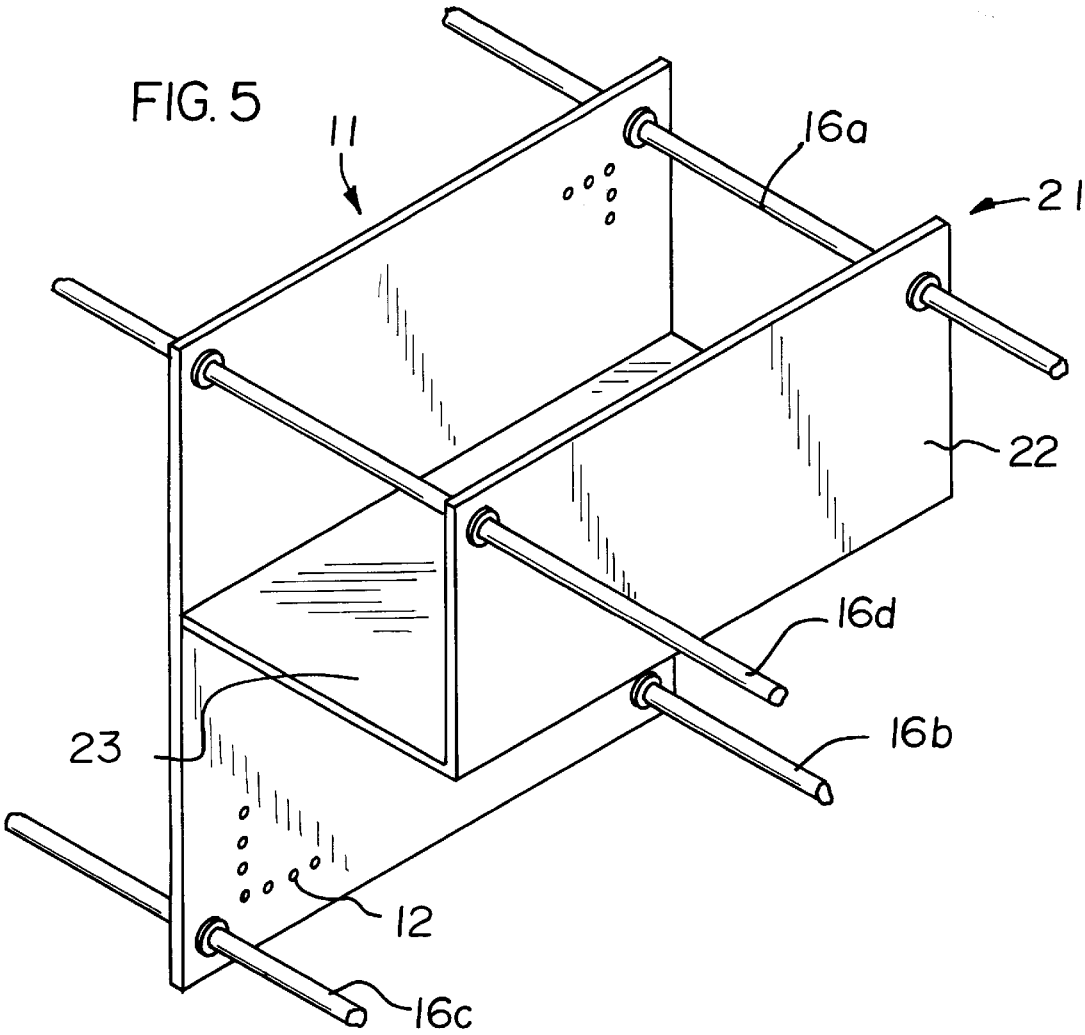
FIG. 5 is a schematic partially perspective view of the present invention with a secondary panel attached.

With reference to FIG. 5, in a preferred embodiment, a generally L-shaped secondary panel 21 is provided having generally rectangular upper and lower portions 22,23 extending substantially perpendicular to one another. The upper portion of the secondary panel has a pair of upper corners and a pair of generally circular holes therethrough. Preferably, each of the upper corners of the upper portion has one of the holes of the upper portion thereadjacent. As shown in FIG. 5, the holes of the upper portion each has one of the rods extended therethrough. In this manner, the upper portion of the secondary panel lie in plane generally parallel to the planes of the panels.

Figure 6:
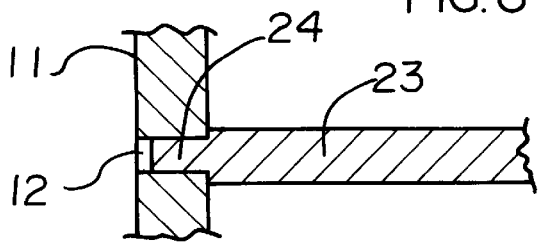
FIG. 6 is a schematic cross sectional view illustrating the insertion of a peg of the lower portion of the secondary panel in FIG. 5 into an aperture of the adjacent panel.

With particular reference to FIG. 6, the lower portion of the second panel terminates at a substantially straight outer edge that has at least one outwardly extending peg 24. Each of the pegs is inserted into a corresponding aperture of an adjacent panel to couple the lower portion of the secondary panel to the adjacent panel preferably with the outer edge of the lower portion abutting the adjacent face of the adjacent panel. In use, the lower portion is designed for serving as a second shelf for resting items thereon above the shelf on which the divider rests.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shelf divider, comprising:

a plurality of spaced apart panels each having substantially planar first and second faces, a plurality of substantially straight sides and a plurality of corners;

wherein said panels each are generally rectangular such that said faces of each panel are generally rectangular, said plurality of sides of each panel comprises four sides, and said plurality of corners of each panel comprises four corners;

said panels each having a plurality of spaced apart generally circular apertures therethrough extending between said faces of each respective said panel;

said apertures being arranged on the respective panel in a generally rectangular grid having a plurality of substantially parallel rows of apertures and a plurality of substantially parallel columns of apertures extending substantially perpendicular to said rows of apertures;

each of said panels having a plurality of generally circular holes therethrough extending between said faces of the respective panel, each of said corners of the respective panel having one of said holes of the respective corner positioned thereadjacent;

wherein said plurality of holes of each panel comprises four holes;

a bottom side of said plurality of sides of each panel being adapted for resting on a resting surface;

said panels being arranged in a row, said first faces of said panels generally facing in a first common direction, said second faces of said panels generally facing in a second common direction opposite said first common direction;

each adjacent pair of panels defining a stall therebetween;

said panels lying in generally parallel planes to one another, wherein said panels lie in generally vertical planes when resting on a horizontal resting surface;

the hole of each corner of each panel being generally coaxially aligned with a corresponding associated hole of each of the other panels;

a plurality of elongate rods, each group of corresponding associated holes of said panel having one of said rods extending therethrough;

wherein said plurality of rods comprises four rods;

each of said rods having a pair of opposite ends and a longitudinal axis extending between said ends of the respective rod;

each of said rods having a generally circular transverse cross section taken substantially perpendicular to the longitudinal axis of the respective rod;

said longitudinal axes of said rods being extended generally parallel to one another, said longitudinal axes of said rods being extended generally horizontally when said bottom sides of said panels are rested on a horizontal resting surface;

each of said rods having a plurality of annular stops disposed therearound, each of said panels being positioned between an associated pair of stops on each of said rods;

each of said stops having annular inner and outer surfaces, said inner surface of each stop defining a generally circular bore through the respective stop, said rods being extended through said bores of the associated stops of the respective rod;

each of said stops having a resiliently compressible annular insert extending radially inwards from said inner surface of the respective stop and extending around the associated rod extending through the bore of the associated stop;

said bore of each stop having a diameter;

said inserts each having an inner diameter less than said diameter of said bore of the associated stop; and said inner diameter of each insert being less than the diameter of the associated rod such that the rod compress each insert to frictionally hold each stop in position on the associated rod.

* * * * *